US005481345A

United States Patent [19]

Ishida et al.

[11] Patent Number: 5,481,345

[45] Date of Patent: Jan. 2, 1996

[54] IMAGE FORMING APPARATUS PROVIDED WITH PRE-TRANSFER CHARGER

[75] Inventors: Hideki Ishida; Kazuhiro Mizude; Hisahiro Kato; Tomohiro Tsutano, all of Osaka, Japan

[73] Assignee: Mita Industrial Co., Ltd., Osaka, Japan

[21] Appl. No.: 283,447

[22] Filed: Aug. 1, 1994

[30] Foreign Application Priority Data

Aug. 9, 1993 [JP] Japan ..... 5-197488

[51] Int. Cl.[6] ..... G03G 15/14

[52] U.S. Cl. ..... 355/273; 355/200; 355/215

[58] Field of Search ..... 355/273, 219, 355/215, 200, 210, 274; 250/324–326; 361/212, 213, 225, 229, 230

[56] References Cited

U.S. PATENT DOCUMENTS

| | | | |
|---|---|---|---|
| 3,784,300 | 1/1974 | Hudson et al. | 355/273 |
| 3,942,006 | 3/1976 | Hayne | 355/215 |
| 3,965,400 | 6/1976 | Tolliver | 355/215 |
| 3,978,379 | 8/1976 | DelVecchio | 355/215 |
| 4,540,268 | 9/1985 | Toyono et al. | 355/210 |
| 4,575,221 | 3/1986 | Onoda et al. | 355/200 |
| 4,803,510 | 2/1989 | Maeda | 355/210 |
| 4,952,989 | 8/1990 | Kawano et al. | 355/210 |
| 5,012,093 | 4/1991 | Shimizu | 355/215 |
| 5,023,748 | 6/1991 | Okamoto et al. | 355/215 |
| 5,105,221 | 4/1992 | Takahashi et al. | 355/210 |
| 5,128,720 | 7/1992 | Creveling | 355/215 |
| 5,134,443 | 7/1992 | Sumi et al. | 355/200 |
| 5,182,694 | 1/1993 | Endo | 361/229 |

FOREIGN PATENT DOCUMENTS

| | | | |
|---|---|---|---|
| 318951 | 6/1989 | European Pat. Off. . | |
| 3223639 | 1/1983 | Germany . | |
| 58-111054 | 7/1983 | Japan | 355/215 |
| 60-134263 | 7/1985 | Japan | 355/215 |
| 62-24279 | 2/1987 | Japan | 355/215 |
| 269790 | 3/1990 | Japan . | |
| 2-69790 | 3/1990 | Japan | 355/273 |
| 2135386 | 5/1990 | Japan . | |
| 3-164771 | 7/1991 | Japan | 355/273 |

OTHER PUBLICATIONS

Patent Abstracts Of Japan, vol. 6, No. 195 (P–146) (1073) 5 Oct. 1982 & JP–A–57 104 164 (Konishiroku Shashin Kogyo) 29 Jun. 1982, abstract.

Patent Abstracts of Japan, vol. 9, No. 90 (P–350) (1813) 19 Apr. 1985 & JP–A–59 218 467 (Fuji Xerox) 8 Dec. 1984, abstract.

Patent Abstracts Of Japan, vol. 13, No. 349 (P–911) (3697) 7 Aug. 1989 & JP–A–01 107 282 (NEC. Corp.) 25 Apr. 1989, abstract.

*Primary Examiner*—A. T. Grimley
*Assistant Examiner*—Shuk Y. Lee
*Attorney, Agent, or Firm*—Jordan and Hamburg

[57] ABSTRACT

An image forming apparatus includes a photosensitive drum rotatable, a developer disposed near the photosensitive drum for developing an electrostatic latent image into a toner image, a transfer disposed on a downstream of the developer for transferring the toner image onto copy paper, and a pre-transfer charger disposed between the developer and the transfer for charging the photosensitive drum at a specified level to assure a smooth transfer of the toner image from the photosensitive drum to the copy paper, the charger including a casing formed with a guide portion for guiding the copy paper to the transfer.

4 Claims, 14 Drawing Sheets

IMAGE FORMING APPARATUS PROVIDED WITH PRE-TRANSFER CHARGER

BACKGROUND OF THE INVENTION

The present invention relates to an image forming apparatus provided with a pre-transfer charger to improve the efficiency in transferring a toner image onto a copy sheet.

Generally, an image forming apparatus comprises a toner image forming unit for forming a toner image, and a toner image transferring device for transferring the toner image onto a copy sheet dispensed from a cassette. The toner image forming unit has a photosensitive drum. Specifically, the copy sheet is transported near a surface of the photosensitive drum and the toner image is transferred onto the copy sheet from the photosensitive drum. The copy sheet is then discharged from the apparatus after the toner image is fixed on the copy sheet by a fixing unit.

Recently, there have been marketed image forming apparatus which are provided with a charger before a toner image transferring device to improve the transferring efficiency of toner image from the surface of the photosensitive drum onto the copy sheet. Such a charger has been generally called a pre-transfer charger.

FIG. 14 is a schematic diagram showing an arrangement of a photosensitive drum and its peripheral devices in a conventional image forming apparatus. A surface of a photosensitive drum 10 is positively charged at a specified level by a main charger 11, and exposed to a light image A reflected from an original document to form an electrostatic latent image. Thereafter, an unnecessary area of the charged surface of the photosensitive drum 10 is removed by a blank lamp 12.

There is provided a developing device 13 containing negatively charged toner particles. Negatively charged toner particles are electrically attracted to the positive latent image on the photosensitive drum surface to develop a toner image.

In synchronism with the exposure and developing operations, a copy sheet is transported to the photosensitive drum 10 by a pair of registration rollers 24. The copy sheet is guided through a sheet transport passage 25 up to the surface of the photosensitive drum 10. The sheet transport passage 25 is constructed by an upper guide plate and a lower guide plate. Upon being transported to the surface of the photosensitive drum 10, the copy sheet is applied with positive electric charges by a transferring device 14 to transfer the toner image onto the copy sheet from the photosensitive drum 10. The copy sheet bearing the toner image is separated from the surface of the photosensitive drum 10 by a separating device 15 which is driven by an alternating current.

A pre-transfer charger 101 is arranged before the sheet transport passage 25 with respect to the rotating direction of the photosensitive drum 10. The pre-transfer charger 101 is driven by an alternating current whose negative component is slightly greater than the positive component. The pre-transfer charger 101 is provided to remove positive electric charges just below the toner image on the surface of the photosensitive drum 10, and to increase the electrical level of the negatively charged toner image. The pre-transfer charger 101 improves the transferring efficiency of toner image onto a copy sheet. Also, the pre-transfer charger 101 assists the transferring device 14 in transferring the toner image onto a copy sheet: which cannot be sufficiently charged by the transferring device due to absorption of moisture in the air.

As described above, in an image forming apparatus provided with a pre-transfer charger, it is necessary to provide both a sheet transport passage and a pre-transfer charger in a limited small space between a developing device and a transferring device.

There has been a strong demand for a compact-sized image forming apparatus. However, the above-mentioned conventional construction, in which the pre-transfer charger 101 is simply provided between the sheet transport passage 25 and the developing device 13 to improve the transferring efficiency, has increased the size of image forming apparatus. This contradicts the above-mentioned demand. Accordingly, a new construction has been greatly demanded for a long time which makes it possible to provide a pre-transfer charger in an image forming apparatus without increasing the apparatus size.

Also, it has been known that driving of a charger generates ozone which gives adverse effects to a photosensitive drum and environment around the apparatus. Accordingly, there has been demanded to remove ozone which the charger generates.

However, a pre-transfer charger is, as mentioned above, provided in limited small space where a developing device, transferring device, sheet transport passage, registration roller pair are densely arranged. Accordingly, there has been another strong demand for a new construction which makes it possible to efficiently remove ozone from a pre-transfer charger without increasing the apparatus size.

Further, a pre-transfer charger is required to be held in a precise positional relationship with respect to a photosensitive drum and sheet transport passage in addition to being provided in a densely arranged space as mentioned above. Accordingly, the construction has been demanded which enables the operator to mount a pre-transfer charger in a specified position easily and accurately when replacing a broken pre-transfer charger with a new charger.

SUMMARY OF THE INVENTION

It is an object of the present invention to provide an image forming apparatus provided with a pre-transfer charger which has overcome the above problems residing in the prior art.

It is another object of the present invention to provide an image forming apparatus provided with a pre-transfer charger which is simple in construction and small in size.

It is another object of the present invention to provide an image forming apparatus provided with a pre-transfer charger which can remove ozone which the pre-transfer charger generates.

It is yet another object of the present invention to provide an image forming apparatus provided with a pre-transfer charger which can assure easier replacement of pre-transfer charger.

The present invention is directed to an image forming apparatus comprising: a photosensitive drum rotatable in a specified direction on which an electrostatic latent image is formed; a developer disposed near the photosensitive drum for developing the electrostatic latent image into a toner image; a transfer disposed on a downstream of the developer with respect to the rotation of the photosensitive drum for transferring the toner image onto copy paper; a charger disposed between the developer and the transfer for charging the photosensitive drum at a specified level to assure a smooth transfer of the toner image from the photosensitive drum to the copy paper, the charger including a casing formed with a guide portion for guiding the copy paper to the transfer.

Further, a guide plate may be disposed between the charger casing and the transfer to define a copy paper transport passage in combination with the guide portion of the charger casing.

The guide portion may be provided with a film having a low friction coefficient.

The casing may be made of a plurality of separatable members. Further, the casing may be provided with an intermediate vertical reinforcing member defining a first chamber and a second chamber, the first chamber having an opening facing the photosensitive drum.

It may be appreciated to form a guide opening in the intermediate vertical reinforcing member in parallel with the charging wire, and provide a charging wire cleaning member movable in the guide opening.

Further, an enclosure member may be provided on an underside of the developer to define an ozone removal space communicating with the first and second chambers through the guide opening formed in the first chamber and an outflow opening formed in the second chamber.

It may be appreciated to assemble the photosensitive drum, the developer, and the charger into a single unit by use of a support frame, and permit the assembly withdrawable from a main body of the image forming apparatus.

Further, it may be appreciated to use a support frame including a front support wall having holding means for holding a front portion of the charger, and a rear support wall having an engagement hole and a guide hole; and a charger including a rear portion having an engagement projection engageable with the engagement hole and a slide member slidable in the guide hole; thereby mounting the charger on the support frame by inserting the slide member in the guide hole, moving the charger further rearward while the slide member being supported at the guide hole until the engagement projection engages with the engagement hole, and rendering the front portion of the charger held by the holding means.

With these image forming apparatus, the copy paper guide portion is formed on the casing of the charger. This makes it possible to discard the upper guide plate which has been used in the conventional image forming apparatus, thus reducing the number of parts and the production costs. Also, the charger can be provided without increasing the size of image forming apparatus.

The combination of the guide plate and the guide portion enhances the reliability of copy paper transport. The provision of the film assures smooth transport of copy paper. The charger casing which is constructed by a plurality of separatable members suppresses high-frequency vibration of the charger casing. The provision of the intermediate vertical reinforcing member increases the bending and torsional strength of the charger casing. The provision of the ozone removal enclosure member on an underside of the developer enables efficient removing of ozone in a limited small space.

The image forming assembly which integrally carries the photosensitive drum, developer, and charger is withdrawable from a main body of the image forming apparatus. Also, the charger is mounted on the support frame while the slide member on the rear portion of the charger is being supported on the guide hole formed in the rear wall of the support frame. Accordingly, charger replacement can be easily performed.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
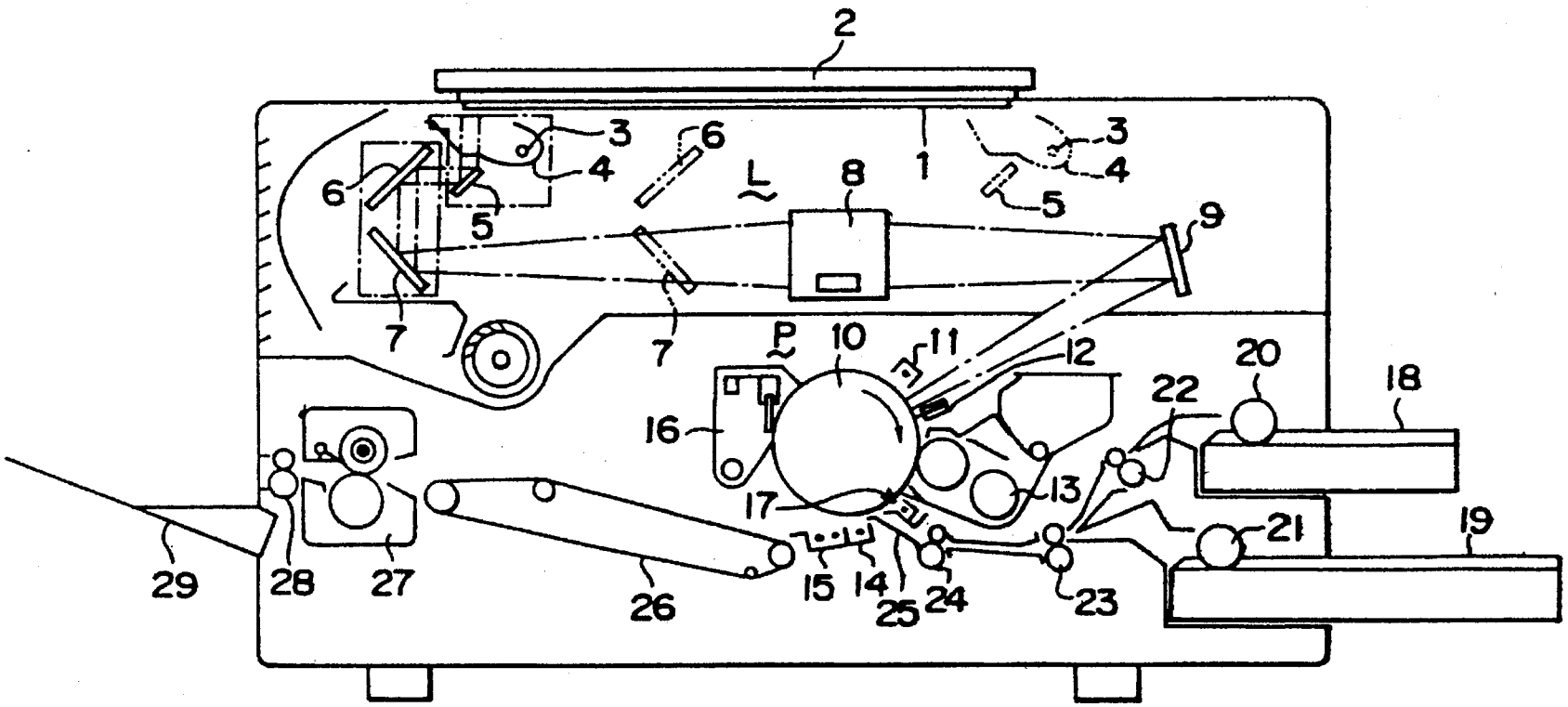
FIG. 1 is a schematic diagram showing an overall construction of an exemplary image forming apparatus according to the invention.

An exemplary image forming apparatus according to the invention will be described with reference to the accompanying drawings. FIG. 1 is a schematic diagram showing an overall construction of the image forming apparatus.

The image forming apparatus comprises a contact glass 1 at a top thereof, a document presser 2 above the contact glass 1, an optical assembly L, an imaging assembly P and a sheet transport assembly for transporting a copy sheet.

The optical assembly L includes an exposure lamp 3, a reflector 4, a light source for illuminating a document placed on the contact glass 1 while reciprocally moving in sidewise directions of the image forming apparatus, reflecting mirrors 5, 6, 7 for reflecting a light image along a specified optical path, a lens unit 8 for adjusting the magnification of light image, and a fixed mirror 9 for directing the reflected light image to a photosensitive drum 10.

The imaging assembly P includes the photosensitive drum 10, a main charger 11, a blank lamp 12, a developing device 13, a pre-transfer charger 17, a transferring device 14, a separating device 15, end a cleaner 16. A peripheral surface of the photosensitive drum 10 is positively charged by the main charger 11 and then exposed to a light image to form an electrostatic latent image. The blank lamp 12 is adapted for removing electric charges on an unnecessary area of the photosensitive drum surface.

The developing device 13 stores negatively charged toner particles. Toner particles are electrically attracted to the latent image on the photosensitive drum surface to thereby develop the latent image into a toner image.

The transferring device 14 has a charger which is driven by a direct current, and positively charges a copy sheet to transfer the toner image to the copy sheet. The separating device 15 has a charger which is driven by an alternating current, and electrically separates the copy sheet bearing the toner image from the surface of the photosensitive drum 10.

The cleaner 16 removes residual toner from the surface of the photosensitive drum 10 after the toner image transfer is completed.

The sheet transport assembly includes cassettes 18, 19 for containing stacks of copy sheets of different sizes, respectively, feed rollers 20, 21 for feeding copy sheets one by one from the cassettes 18, 19, transport roller pairs 22, 23, and a registration roller pair 24 of an upper roller 241 and a lower roller 242, and a sheet transport passage 25 for guiding a copy sheet. The sheet transport assembly further includes on a downstream side after the photosensitive drum 10 a transport belt 26 for transporting the copy sheet bearing the toner image further downstream, a fixing device 27 for fixing the toner image on the copy sheet, and a pair of discharge rollers 28 for discharging the copy sheet bearing the fixed copy image to a discharge tray 29.

The sheet transport passage 25 is defined by a guide member 251 and a guide portion 45 formed on the pre-transfer charger 17 as described later Referring to FIG. 2, the developing device 13, the upper roller 241, the pre-transfer charger 17, the photosensitive drum 10 and the cleaner 16 are assembled into a single unit to form an image forming unit S. On the other hand, the lower roller 242, the guide member 251, the transferring device 14, and the separating charger 15 are together mounted on a main body R of the image forming apparatus. In other words, the image forming unit S is separatable from the main body R along a copy sheet passing course. The image forming unit S is withdrawn from the main body R as shown in FIG. 3.

Next, the pre-transfer charger 17 will be described in more detail with reference to FIGS. 4 to 13. The pre-transfer charger 17 is disposed near the copy sheet passing course along which the copy sheet is transported to the photosensitive drum 10. The pre-transfer charger 17 includes a charging wire 71 and a shield casing 72. The pre-transfer charger 17 is detachably mounted on a support frame of the image forming unit S to clean the wire or replace the wire with a new one.

A construction of the shield casing 72 will be described with reference to FIGS. 2, 4, 5A, and 5B. The shield casing 72 is constructed by an upper member 41, side member 42, and lower member 43 which are respectively shaped into specified forms as shown in FIG. 5B. These members are made of electrically conductive material, such as aluminum, iron, stainless steel. The upper member 41 and the side member 42 are connected with each other by spot welding. The upper and side members 41, 42 are connected with the lower member 43 by a screw. Further, an L-shaped member 30 is connected on a specified position of the lower member 43 by spot welding. FIG. 5A shows the thus constructed shield casing 72.

The shield casing 72 is, as shown in FIG. 5A, assembled into a box-like form which provides sufficient bending and torsional strengths. Also, the shield casing 72 has an opening facing only toward the photosensitive drum 10 to direct corona discharge of the charging wire 71 toward the photosensitive drum 10.

It is to be noted that high frequency vibrations are conventionally likely to occur in a shield casing when a charging wire is driven. In this embodiment, however, the members 41, 42, 43 constituting the shield casing 72 have different shapes and sizes from one another, and thus have different natural frequencies. Also, the shield casing 72 is constructed by connecting the members 41, 42, 43 by the means of spot welding and screw, instead of an entirely molded member. Accordingly, this construction will allow these members 41, 42, 43 to interfere with one another even when these members high-frequently vibrate due to the driving of the charging wire 71 to consequently suppress the entire of shield casing 72 from vibrating in higher magnitudes.

The upper member 41 has a vertical portion 31*a*. The member 30 has a vertical portion 31*b*. The vertical portions 31*a* and 2to define a guide 31a and 31*b* vertically face each other opening 31*c* along which a cleaning member 32 is moved. A movement of the cleaning member 32 will be described later. Also, these vertical portions 31*a* and 31*b* increase the bending and torsional strength of the shield casing 72 and reinforce the shield casing 72.

The vertical portions 31*a*, 31*b* are provided at an intermediate portion of the shield casing 72 to further increase the bending and torsional strengths of the shield casing 72. Also, the upper member 41 is formed with an upper opening 31*d*.

The lower member 43 is formed with the guide portion 45. The lower member 43 is positioned along the copy sheet passing course. The guide portion 45 extends near the photosensitive drum 10 when the shield casing 72 is mounted, and is bent in such a direction as to guide the copy sheet being transported by the registration roller pair 24 into a gap between the transferring device 14 and the photosensitive drum 10.

In this way, the sheet transport passage 25 is defined by the guide member 251 and a bottom portion and the guide portion 45 of the lower member 43 of the shield casing 72. In other words, the sheet transport passage 25 can be formed without providing an additional guide member. Accordingly, the number of parts to constitute the sheet transport passage 25 can be reduced, thereby reducing the production costs.

This construction eliminates the need of providing a space for an upper guide member to define a transport passage which has been required in the conventional apparatus. Accordingly, compact-sized image forming apparatus can be produced even with providing a pre-transfer charger.

Also, by utilizing the space which has been occupied by the upper guide member of the sheet transport passage in the conventional apparatus, an ozone removal device can be provided as will be described later.

The lower member 43 is attached with a synthetic resin film 36 made of polyester on an underside thereof. The synthetic resin film 36 has a low friction coefficient and is adapted for ensuring the copy sheet to be smoothly guided into the gap between the photosensitive drum 10 and the transferring device 14.

In particular, just when the copy sheet goes out of the sheet transport passage 25, a trailing end portion of the copy sheet is likely to spring up due to the inherent force of the copy sheet restoring to the original straight form. The guide portion 45 of the shield casing 72 prevents the trailing end portion of the copy sheet from springing up, and the synthetic resin film 36 ensures smooth transporting of copy sheet.

guide portion 45 is not limited in the straight form shown in FIG. 5A, but it may shaped into a smooth curved form.

Figure 6A:
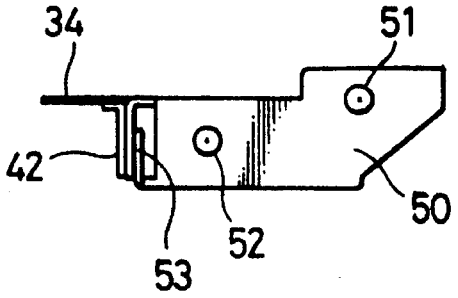
FIG. 6A is a rear elevation view of the pre-transfer charger viewed from the direction of the arrow B in FIG. 4.
Figure 6B:
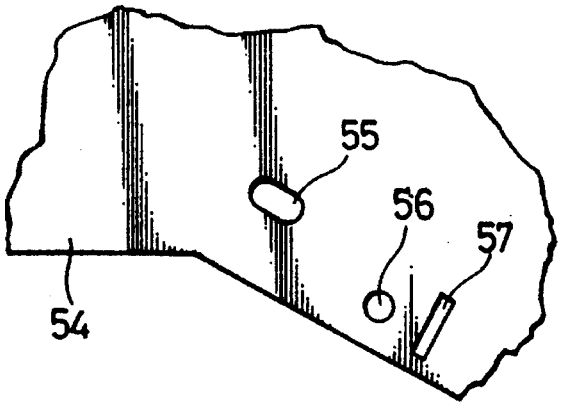
FIG. 6B is a front elevation view showing a related portion of a rear wall of a support frame of the image forming unit to which the pre-transfer charger is to be mounted.
Figure 6C:
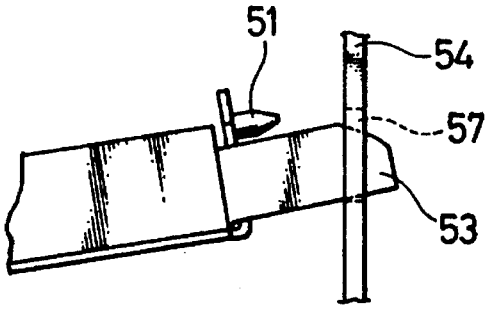
FIG. 6C is a side elevation view showing a state where the pre-transfer charger is being mounted to the rear support wall of the image forming unit.

Next, attachment of the pre-transfer charger 17 on the image forming unit S will be described with reference to FIGS. 4, 6A to 6C, and 7A to 7C. The shield casing 72 has rear plate 50 at a rear portion thereof. The rear plate 50 is provided with projections 51, 52 and a slide arm 53 extending rearward. On the other hand, the support frame of the image forming unit S has a rear wall 54 at a rear portion thereof. As shown in FIG. 6B, the rear wall 54 is formed with an oblong hole 55, a hole 56, and a slot 57 at specified positions corresponding to the projections 51, 52, and the slide arm 53 on the rear plate 50 of the shield casing 72.

Figure 4:
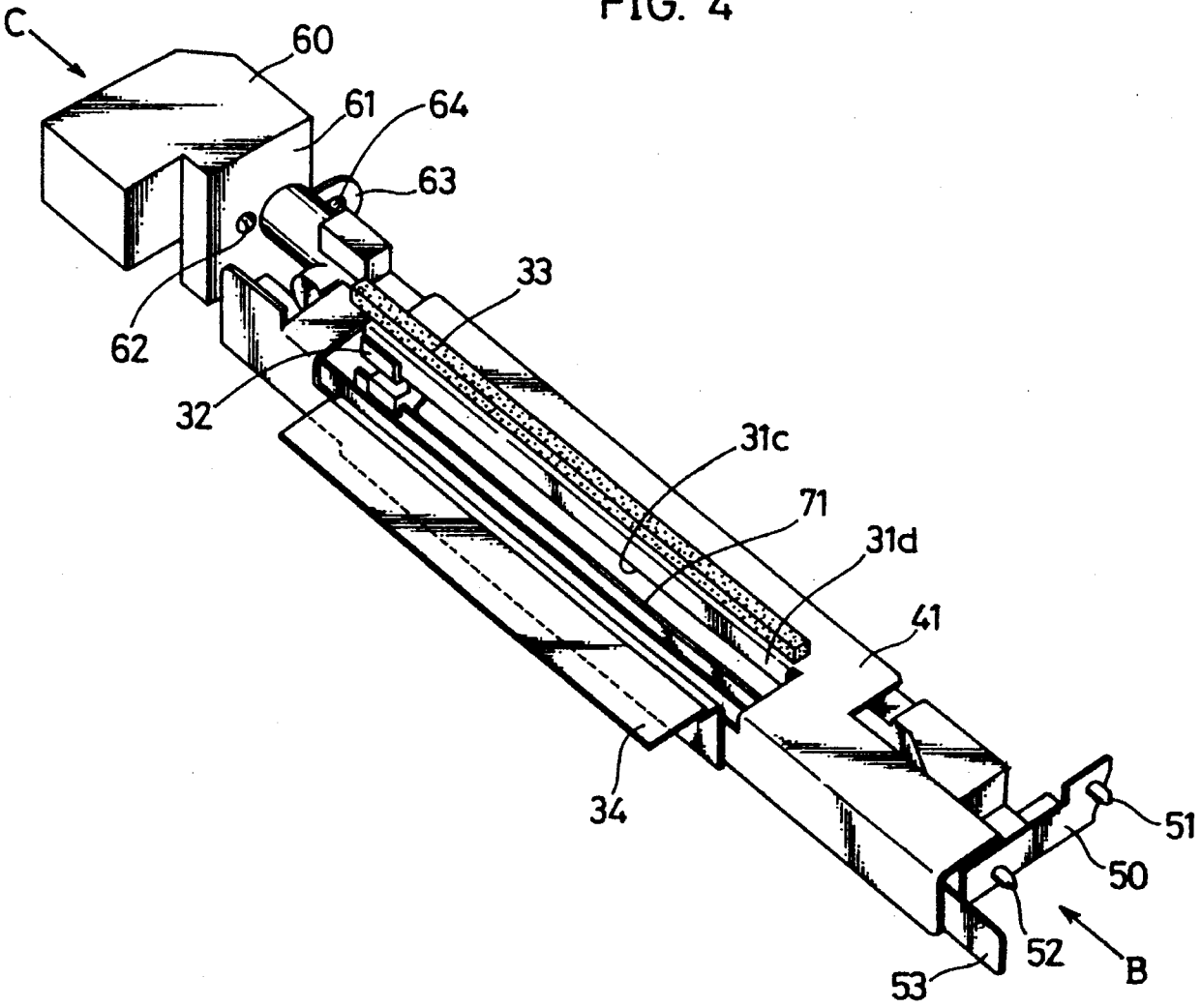
FIG. 4 is a perspective view showing a pre-transfer charger to be mounted on the image forming apparatus.
Figure 5A:
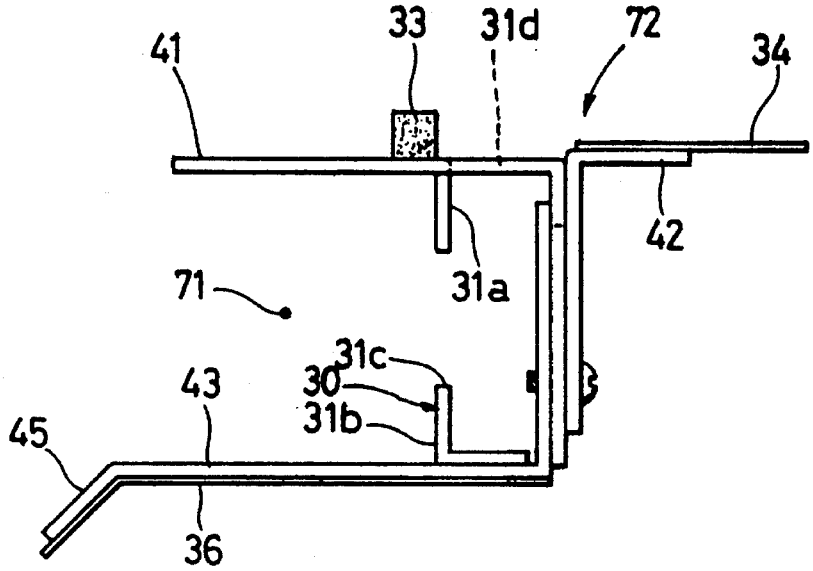
FIG. 5A is a front elevation view of a shield casing of the pre-transfer charger.
Figure 5B:
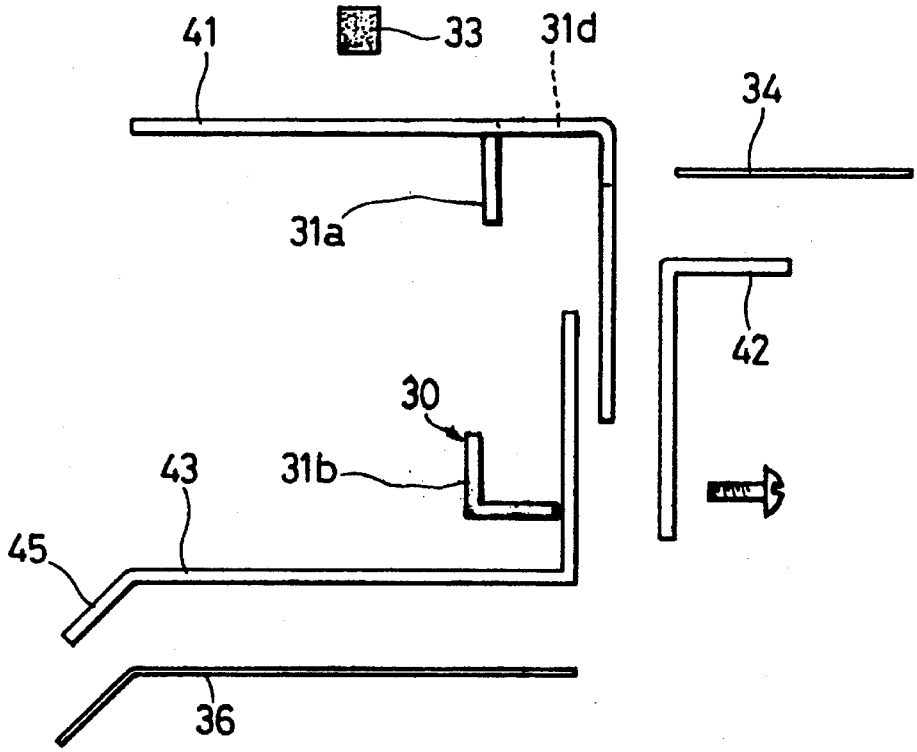
FIG. 5B is a front elevation view of exploded parts of the shield casing.

Further, the shield casing 72 is attached with a driving box 60 at a front end thereof as shown in FIG. 4. The driving box 60 contains a driving mechanism for driving a cleaning member. The driving box 60 has an inner wall 61 formed with a hole 62, and an attachment arm 63 extending in a sidewise direction. The attachment arm 63 is formed with an oblong hole 64 in a specified portion thereof.

Figure 7A:
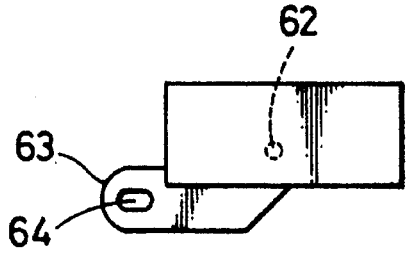
FIG. 7A is a front view of the pre-transfer charger viewed from the direction of the arrow C in FIG. 4.
Figure 7B:
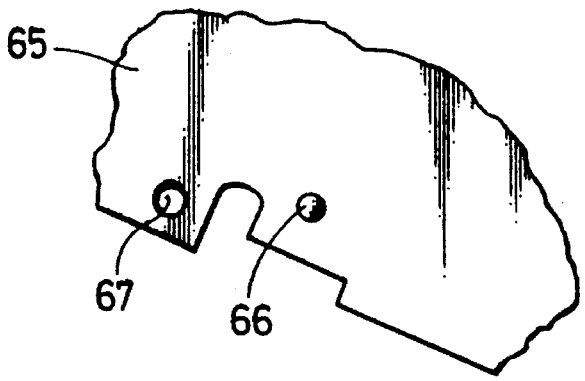
FIG. 7B is a front view of a front wall of the support frame of the image forming unit to which the pre-transfer charger is to be mounted.
Figure 7C:
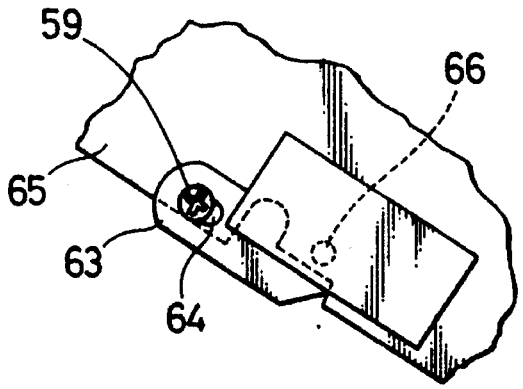
FIG. 7C is a front view showing a state where the pre-transfer charger is mounted on the support frame of the image forming unit.

On the other hand, the support frame of the image forming unit S has a front wall 65 which is formed with a projection 66 and a threaded hole 67 corresponding to the hole 62 and the oblong hole 64 respectively, as shown in FIG. 7B.

The pre-transfer charger 17 is attached on the support frame of the image forming unit S as follows. First, the slide arm 53 on the rear plate 50 is placed in the slot 57 of the rear wall 54 of the support frame of the image forming unit. Thereafter, the pre-transfer charger 17 is moved rearward further while the slide arm 53 being supported at a lower end of the slot 57 until the projections 51, 52 on the rear plate 50 engage with the oblong holes 55, 56 formed in the rear wall 54 of the support frame.

After the engagement of the rear projections 51 and 52, the hole 62 formed in the front-arranged driving box 60 engages with the projection 66 formed on the front wall of the support frame by pushing up a front portion of the pre-transfer charger 17. Consequently, the pre-transfer charger 17 is mounted on the support frame of the image forming unit S, and then fastened on the support frame by turning a screw 59 in the threaded hole 67 formed in the front wall 65 of the support frame through the oblong hole 64 of the attachment arm 63 on the driving box 60.

The rear portion of the pre-transfer charger 17 is supported on the rear wall 54 of the support frame with the engagement of the projections 51, 52 and the holes 55, 56. The front portion of the pre-transfer charger 17 is supported on the front wall 65 of the support frame with the engagement of the projection 66 with the hole 62 and the screw 59. In this way, the pre-transfer charger 17 can be easily and firmly attached on the support frame. Accordingly, it will be seen that this arrangement makes it possible to easily replace a broken pre-transfer charger 17 with a new one without impairing the precise positional relationship between the guide portion 45 and the charging wire 71 of the pre-transfer charger 17 and the surface of the photosensitive drum 10 which is also supported on the support frame of the image forming unit S.

Figure 9:
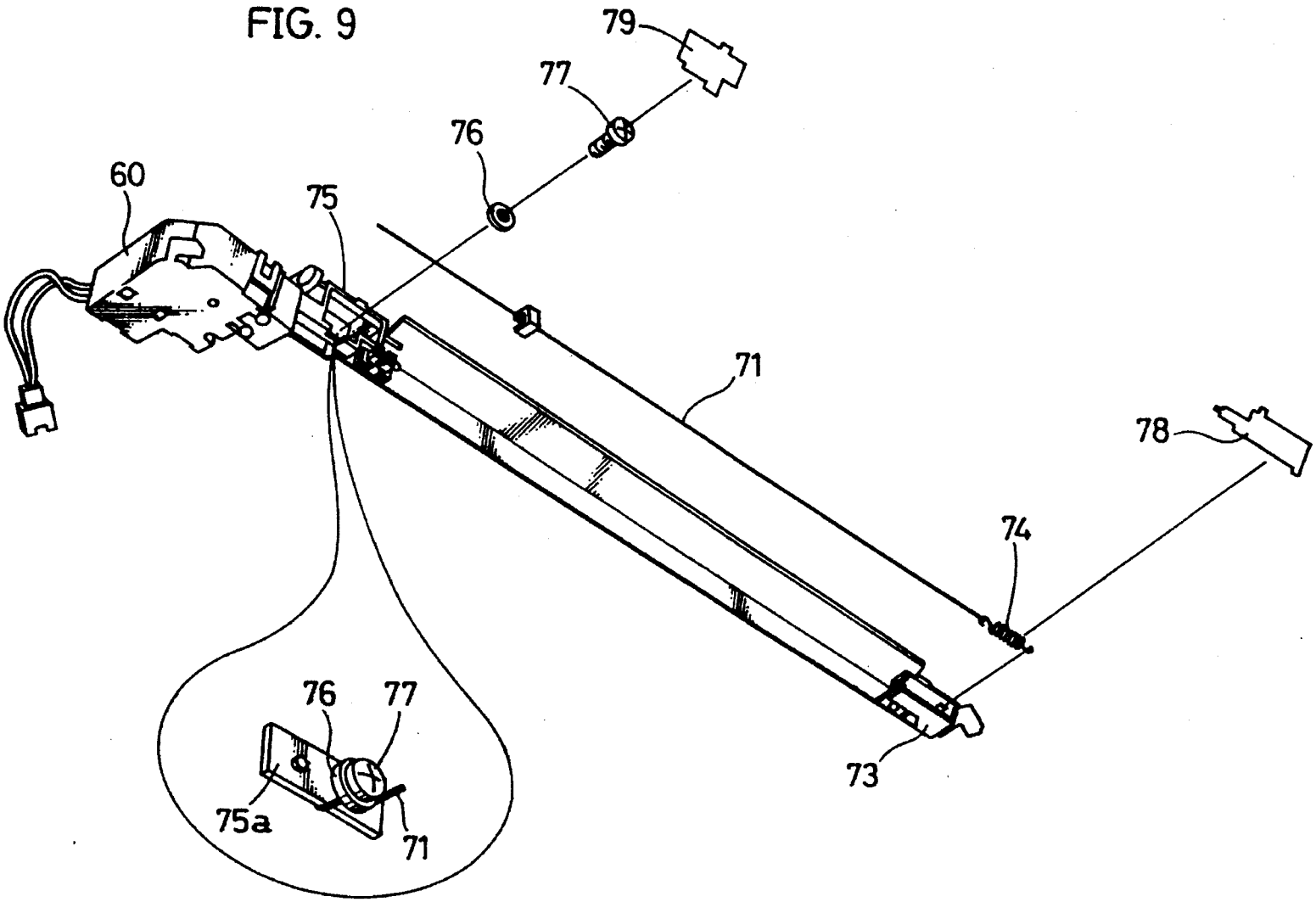
FIG. 9 is a perspective view of a charging portion of the pre-transfer charger in a state where a charging wire being mounted.
Figure 10A:
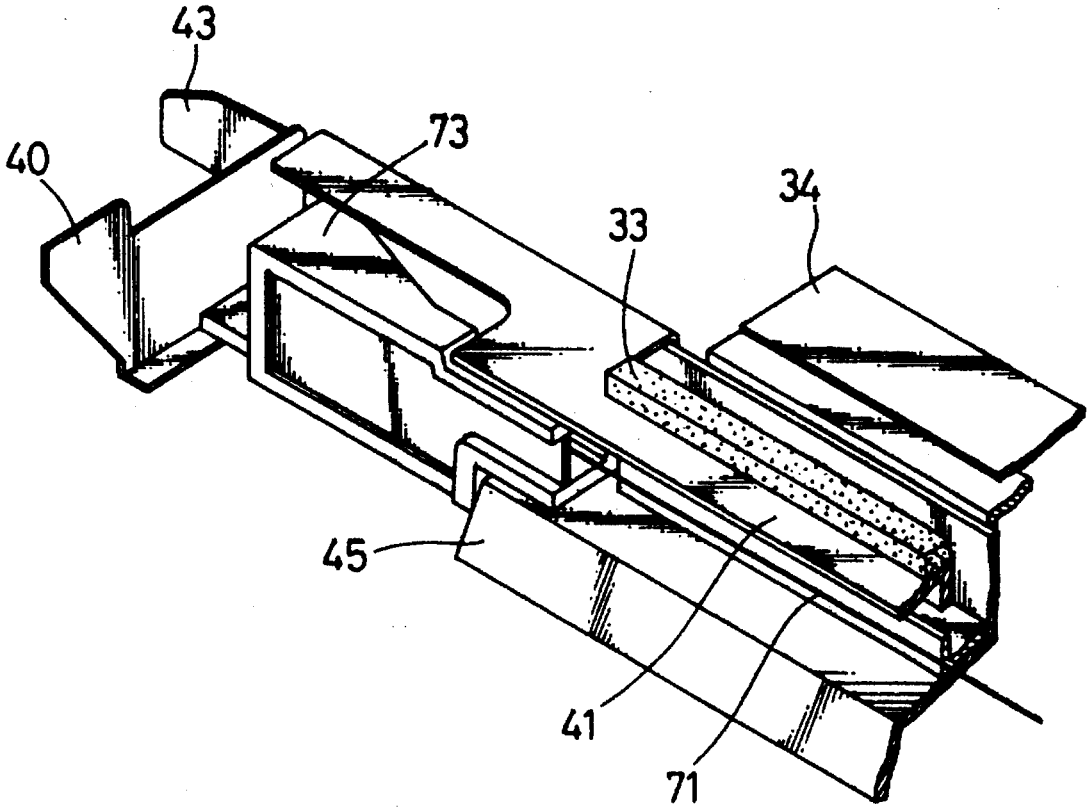
FIG. 10A is a perspective view showing a rear portion of the pre-transfer charger.
Figure 10B:
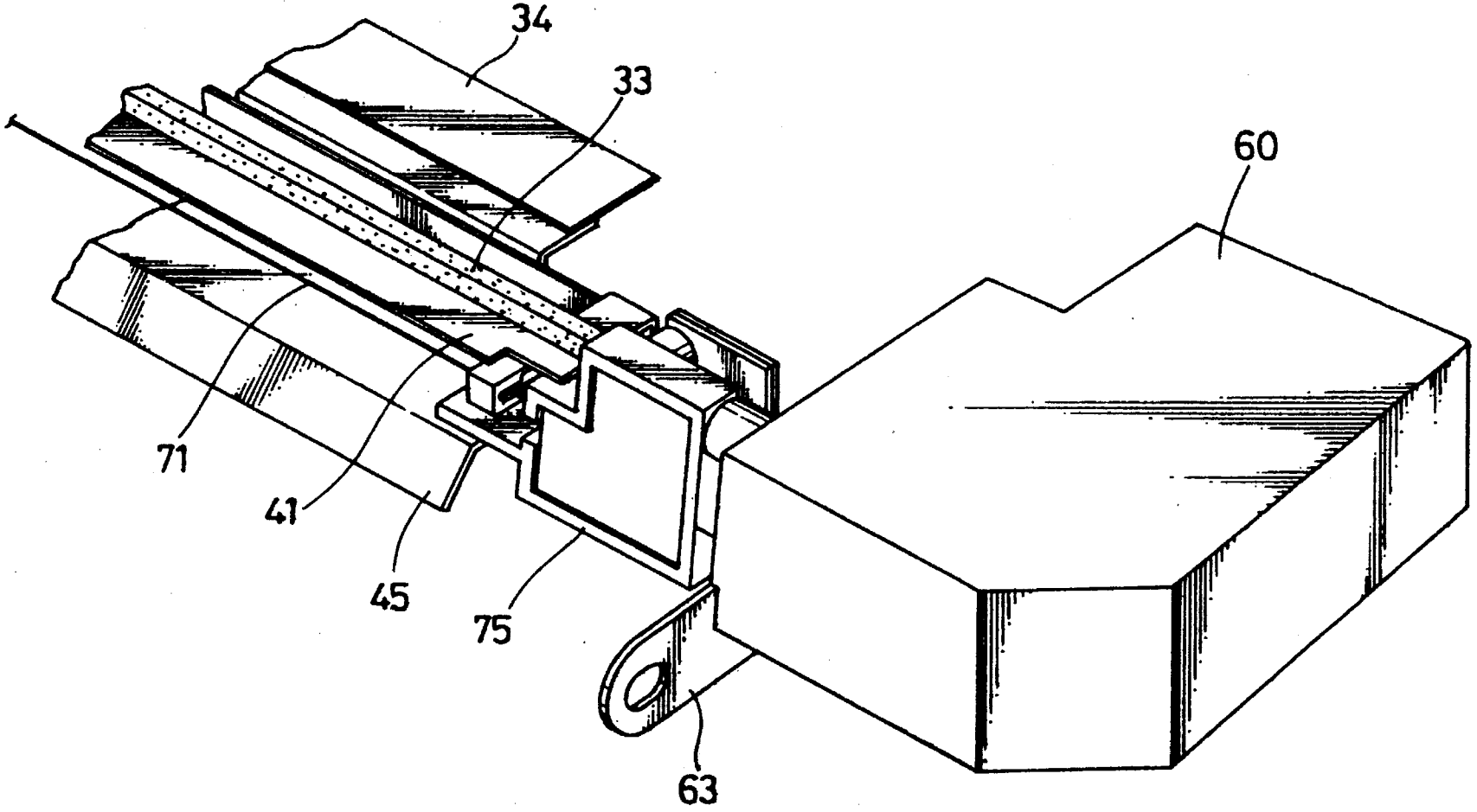
FIG. 10B is a perspective view showing a front portion of the pre-transfer charger.

Attachment of the charging wire 71 on the pre-transfer charger 17 will be described with reference to FIGS. 9, 10A, and 10B.

charging wire 71 is very thin and made of tungsten. The charging wire generates a corona discharge when being applied with a high voltage alternating current whose negative component is slightly greater than the positive component. The corona discharge electrically levels off the positively charged surface area of the photosensitive drum 10 on which a toner image is formed, and increases the negative electric level of the toner particles forming the toner image.

Figure 13:
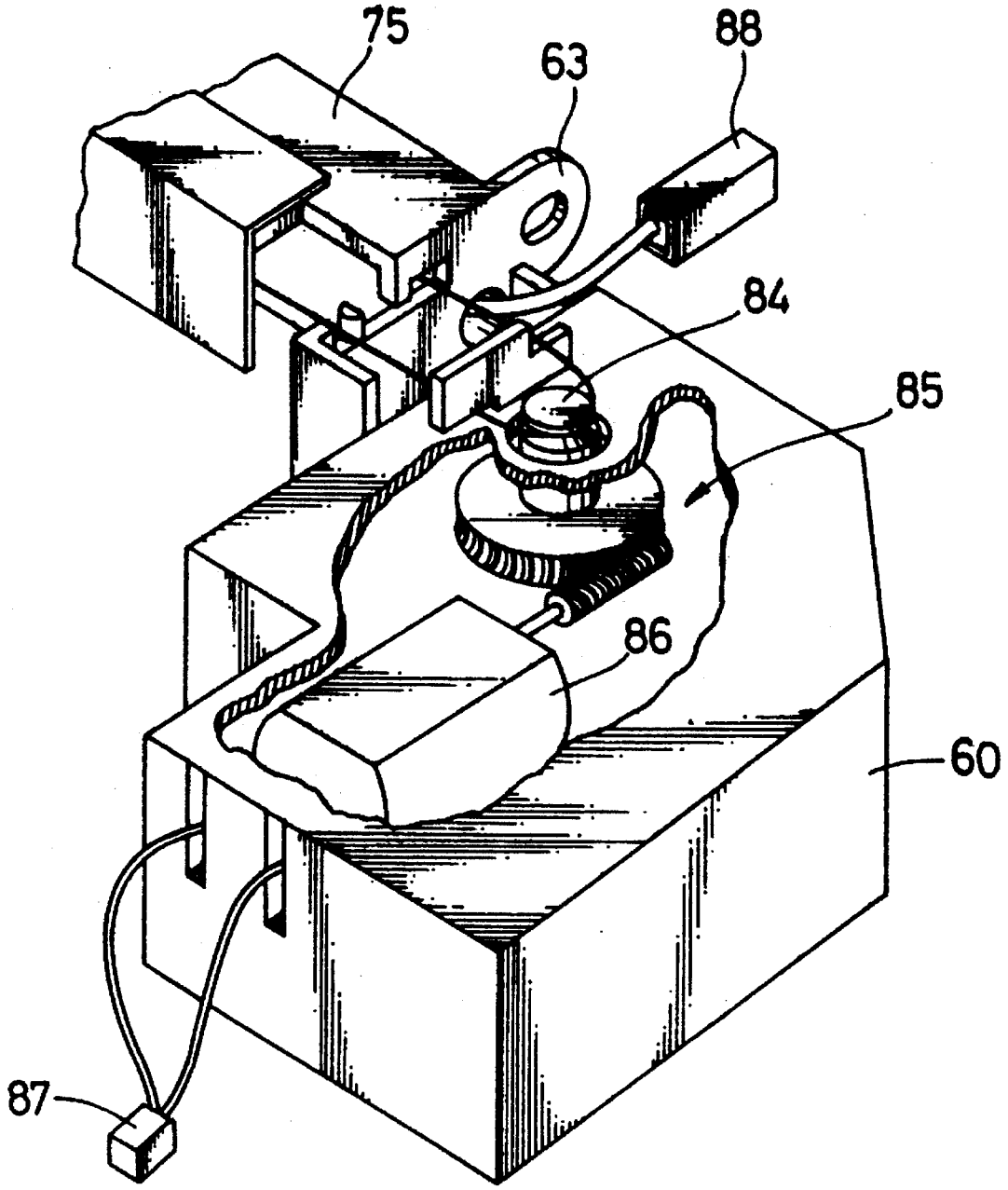
FIG. 13 is a partially cut-out perspective view showing a front portion of the pre-transfer charger, viewed from the bottom, showing a driving mechanism for driving the cleaning member.
Figure 14:
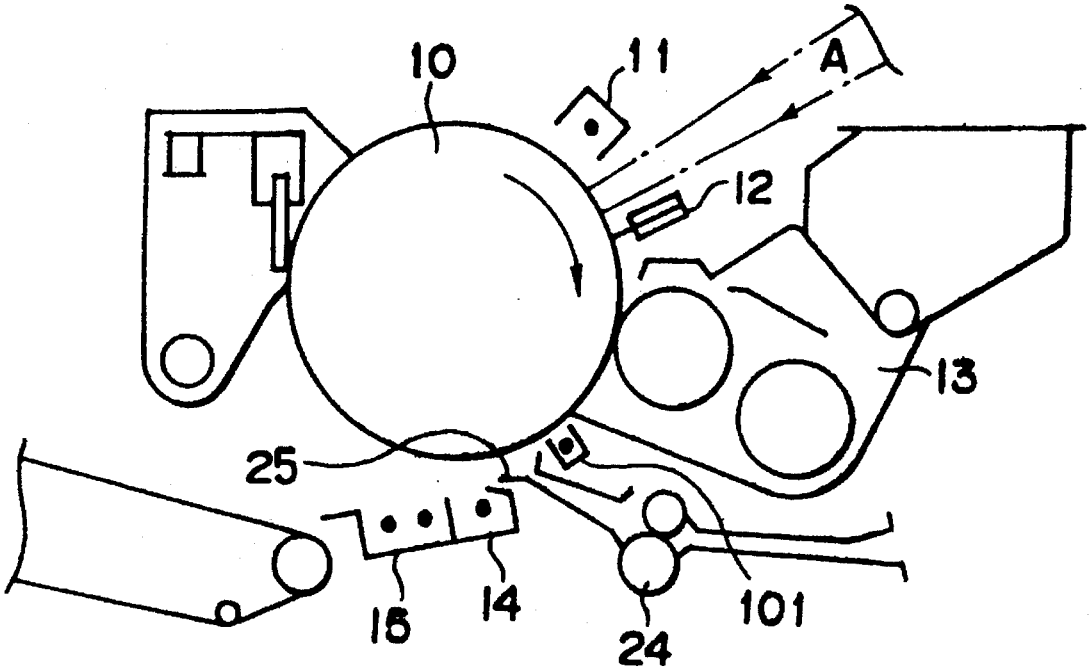
FIG. 14 PRIOR ART
FIG. 14 is a schematic diagram showing a photosensitive drum and its peripheral devices of an image forming apparatus in the prior art.

A rear end of the charging wire 71 is connected with a spring 74 attached in a rear end block 73 provided in a rear end of the shield casing 72 while a front end of the charging wire 71 is fixedly secured to a metallic attachment member 75*a* in a front end block 75 provided in a front end of the shield casing 72. The front end of the charging wire 71 is secured on the attachment member 75*a* with use of a washer 76 and a screw 77. The charging wire 71 is stretched along a longitudinal direction of the shield casing 72. The screw 77 is connected to a high-voltage power source by way of a connector 88 as shown in FIG. 13. The rear and front end blocks 73 and 75 are attached with covers 78 and 79 to protect their respective internal constructions.

Figure 11:
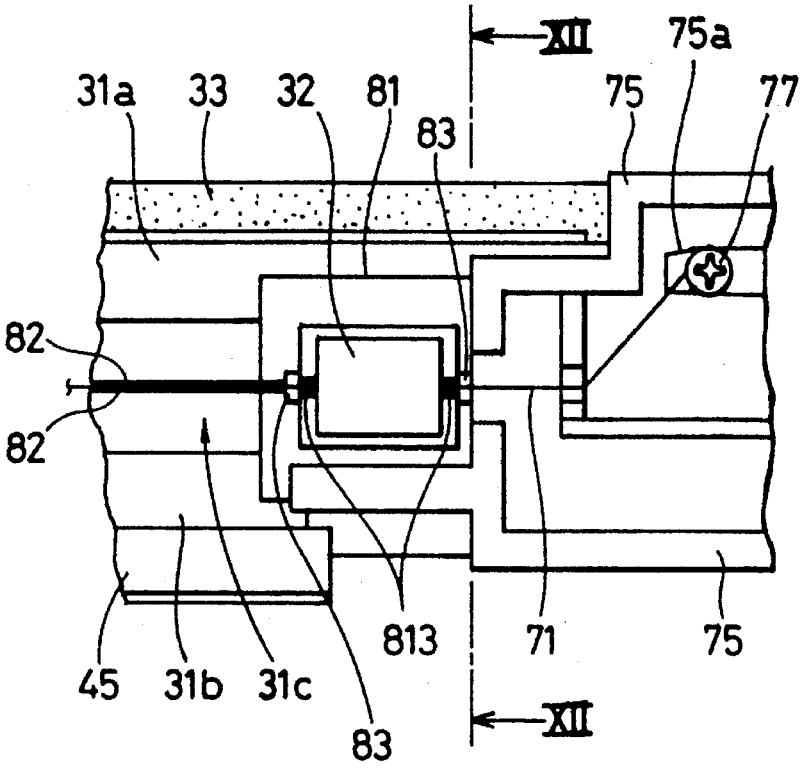
FIG. 11 is a front view of a cleaning member provided in the pre-transfer charger.
Figure 12:
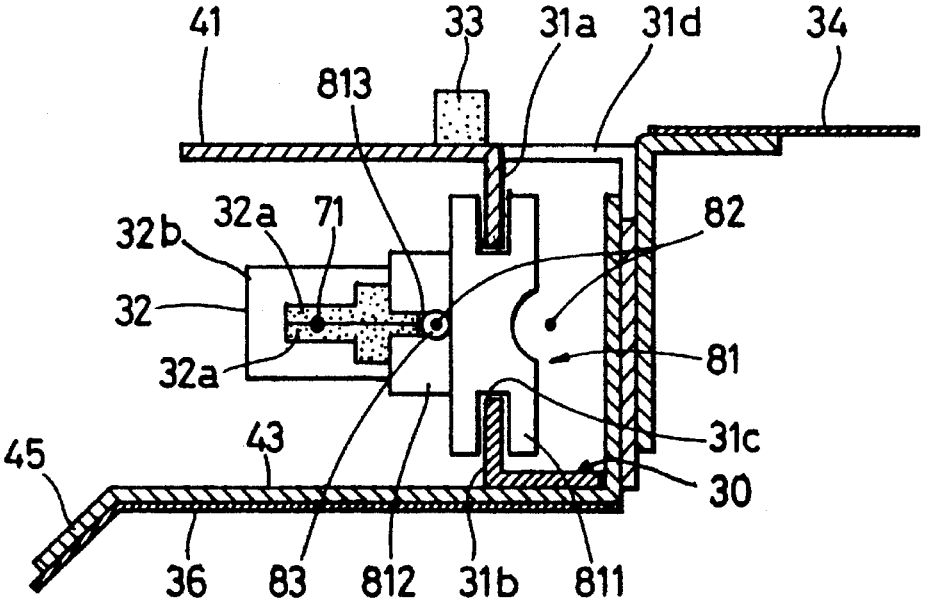
FIG. 12 is a sectional view taken along the line XII—XII in FIG. 11.

A cleaning mechanism for cleaning the charging wire 71 will be described with reference to FIGS. 11 to 13.

The cleaning mechanism includes a movable member 81 and the cleaning member 32 attached on the movable member 81. The cleaning mechanism is adapted for removing dusts and other matter from the charging wire 71 to keep a uniform corona discharge.

The movable member 81 comprises a slide block 811 and a holding boss 812 projecting from the slide block 811. The slide block 811 is slidably fitted in the guide opening 31*c*. Specifically, the slide block 811 is formed with grooves in upper and lower end surfaces thereof. The grooves are engaged with an lower end of the vertical portion 31*a* and an upper end of the vertical portion 31*b* so that the slide block 811 is held between the vertical portions 31*a* and 31*b*. Consequently, the slide block 811 is movable along the stretched charging wire 71.

The holding boss 812 is adapted for holding the cleaning member 32. The holding boss 812 is formed with a hollow portion in a center portion thereof and grooves 813. These grooves 813 are arranged in parallel with the extending direction of the charging wire 71.

The cleaning member 32 includes a pair of contact members 32*a* and a clipping cover 32*b*. The contact member 32*a* are made of a sponge, soft synthetic resin or the like, and sandwiches the charging wire 71 therebetween. The pair of contact members 32*a* is inserted in the hollow portion of the holding boss 812 together with the clipping cover 32*b*.

The movable member 81 is fixedly connected to an endless driving wire 82 by fastening members 83. The endless driving wire 82 is wound around a drive pulley 84 disposed in the driving box 60 and an unillustrated idle pulley disposed in the rear end portion of the shield casing 72. The drive pulley 84 is connected to a motor 86 through worm gear mechanism 85. The motor 86 is connected with the power source by way of a connector 87.

With the above arrangement, the drive pulley 84 is rotated by the motor 86 to move the driving wire 82. Consequently, the movable member 81 moves along the guide opening 31*c* and the cleaning member 32 moves along the extending direction of the charging wire 71 together with the movable member 81 to thereby clean he charging wire 71.

Upon the cleaning member 32 reaching one end of the charging wire 71, the rotating direction of the motor 86 is changed to the reverse direction, and the movable member 81 is moved along the guide opening 31*c* in the reverse direction. While the movable member 81 being moved in the reverse direction, the cleaning member 32 cleans the charging wire 71 in the reverse direction. When the movable member 81 returns to the initial position, cleaning of the charging wire 71 is completed.

As described above, since the charging wire 71 is reliably cleaned with the cleaning member 32, a uniform corona discharge can be kept.

Figure 8:
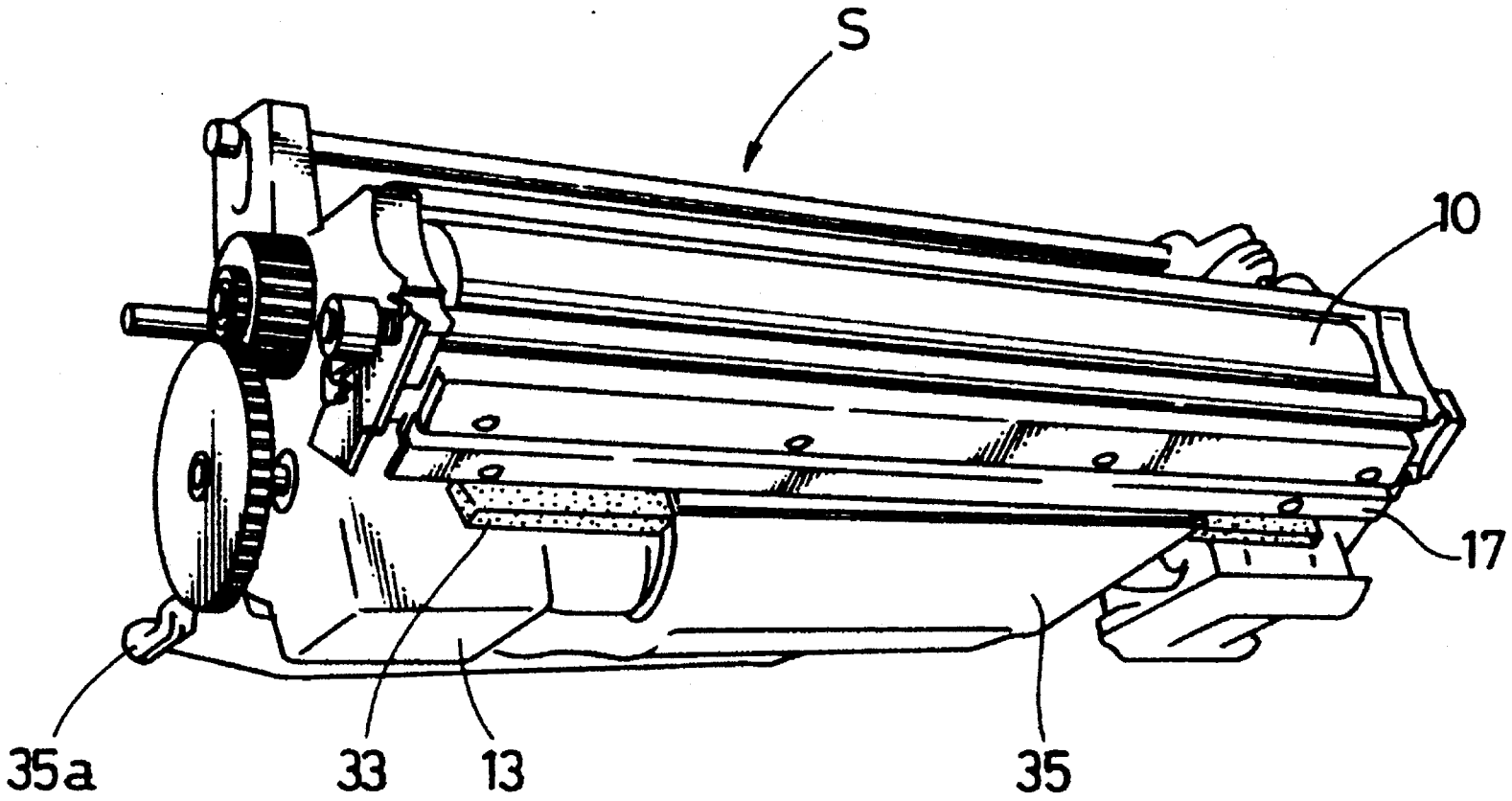
FIG. 8 is a perspective view of the image forming unit provided with an ozone removal enclosure member.

Next, an ozone removing construction will be described with reference to FIGS. 2 and 8. In this embodiment, there is provided with an arrangement for removing ozone which occurs around the charging wire 71 due to the corona discharge.

Specifically, an enclosure member 35 in the form of a tray is provided on an underside of the developing device 13. The enclosure member 35 has a specified depth to define an ozone removal duct. The enclosure member 35 and the underside of the developing device 13 forms a closed space except an inflow portion and an outflow portion 35*a*.

The outflow portion 35*a* is air-tightly connected to a fan duct provided in a main body of the image forming apparatus. The fan duct is provided with a filter containing activated charcoal.

The ozone removal duct is communicated with the pre-transfer charger 17 through the inflow portion. Specifically, the ozone removal duct is communicated with the chamber in which the charging wire 71 is stretched by way of the guide opening 31*c* and the upper opening 31*d*. In other words, the guide opening 31*c* serves as a vent for discharging the ozone from the charging wire chamber of the pre-transfer charger 17 as well as guiding the movable member 81 of the charging wire cleaning mechanism.

Figure 2:
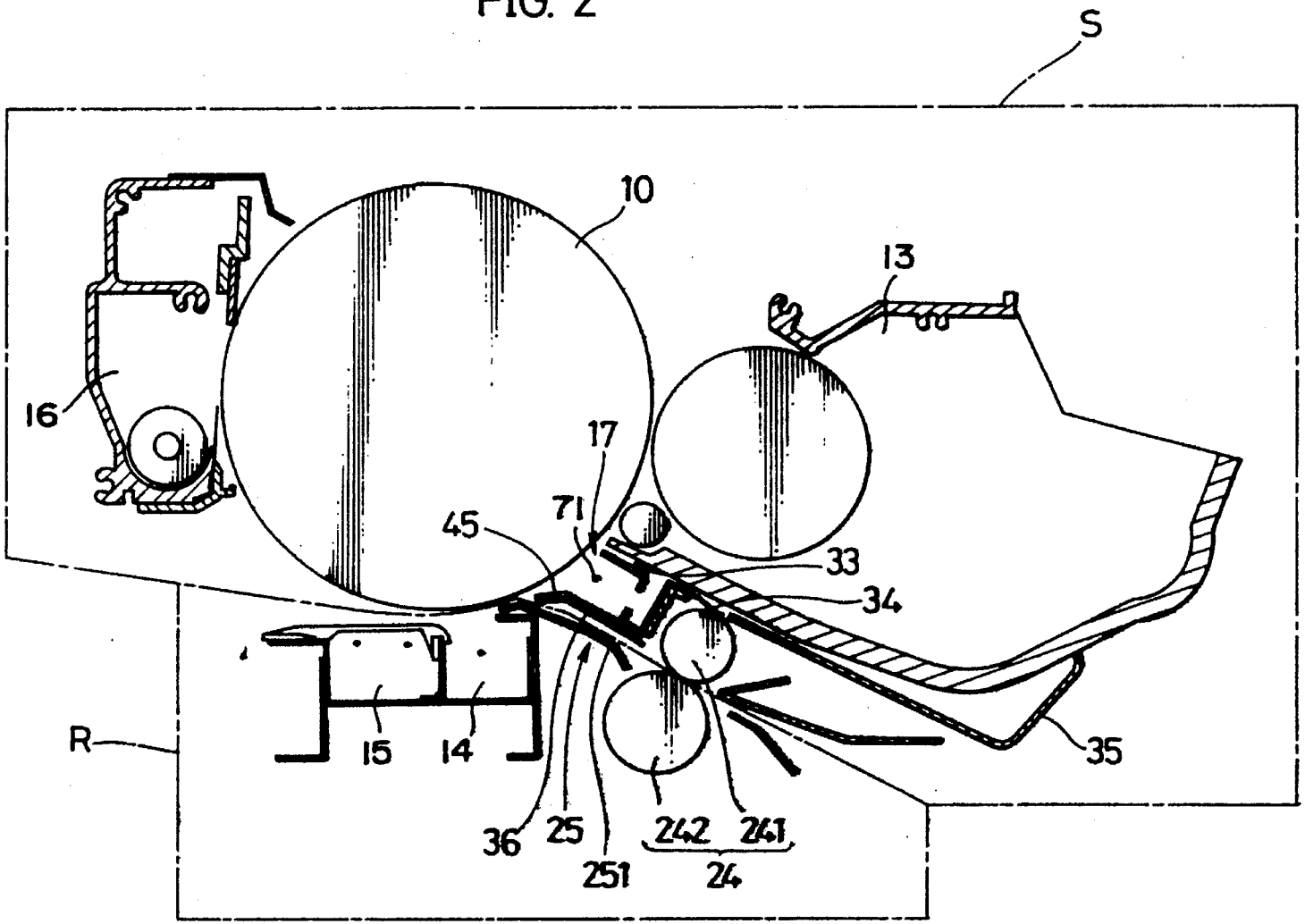
FIG. 2 is a diagram showing a detailed construction of a photosensitive drum and its peripheral devices in the image forming apparatus.
Figure 3:
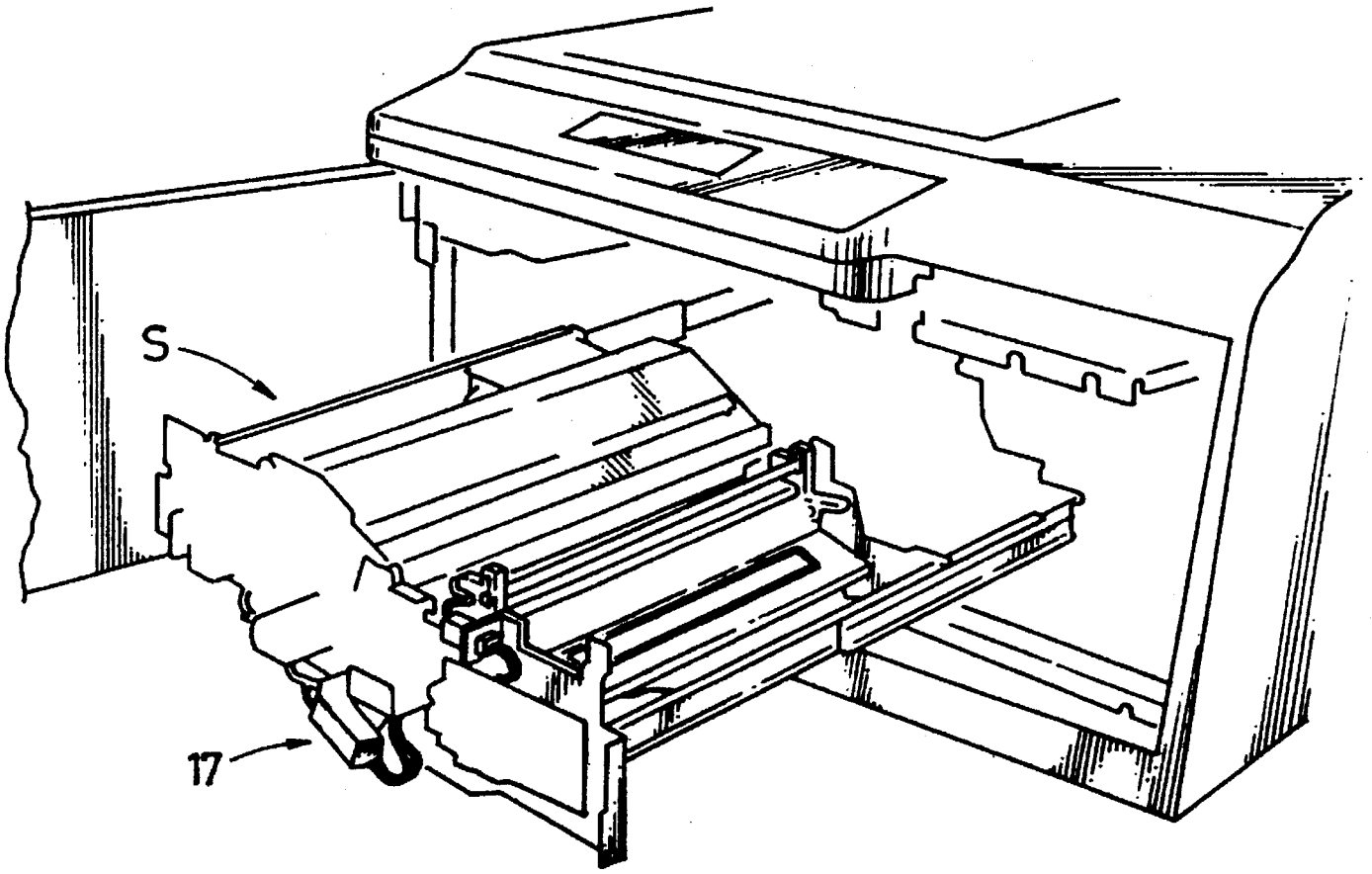
FIG. 3 is a perspective view showing an image forming unit being withdrawn out of a main body of the image forming apparatus.

A sponge 33 is attached on a top surface of the upper member 41, and comes into contact with an underside of the developing device 13 when the pre-transfer charger 17 is mounted on the image forming unit S as shown in FIG. 2. The sponge 33 keeps the ozone from leaking toward the photosensitive drum 10.

Further, a sealing strip 34 is attached on a top of the side member 42. The sealing strip 34 is made of a soft synthetic resin and brought into contact with the upper roller 241 of the registration roller pair 24 when the pre-transfer charger 17 is mounted on the image forming unit S, thereby keeping the ozone from leaking toward the registration roller pair 24.

The ozone which occurs in the charging wire chamber of the pre-transfer charger 17 is efficiently removed through the ozone removal passage which is provided in such a limited small space. Consequently, a rise in the ozone concentration can be reliably prevented.

An operation of the image forming apparatus will be described. Upon the copying operation being started, the main charger 11 is driven to charge the photosensitive drum 10 at a specified level. A document placed on the contact glass 1 is illuminated by the exposure lamp 3. The reflected light is introduced by way of the reflecting mirrors 5, 6, and 7 to the lens unit 8, and then through the fixed mirror 9 to the charged surface of the photosensitive drum 10 to form an electrostatic latent image. Subsequently, the latent image on the photosensitive drum 10 is developed to a toner image by the developing device 13.

A copy sheet is fed from the cassette 18 or 19 by the feed roller 20 or 21, and transported to the image forming assembly by the transport rollers 22, 23. The copy sheet is transported further to the space between the photosensitive drum 10 and the transferring device 14 by the registration roller pair 24. In this time, the copy sheet is guided to the space by the guide portion 45 formed on the pre-transfer charger 17.

The copy sheet is applied with positive electric charge at a specified level by the transferring device 14 to electrically attract the toner image from the photosensitive drum 10. Subsequently, the copy sheet bearing the toner image is separated from the surface of the photosensitive drum 10 by the separating device 15. The copy sheet separated from the photosensitive drum 10 is transported downstream by the transport belt 26 up to the fixing device 27 where the toner image is fixed on the copy sheet. The copy sheet having the image fixed thereon is discharged to the tray 29 by the discharge roller pair 28.

What is claimed is:

1. An image forming apparatus comprising:

a photosensitive drum rotatable in a specified direction on which an electrostatic latent image is formed;

a developer disposed near the photosensitive drum for developing the electrostatic latent image into a toner image;

a transfer disposed on a downstream of the developer with respect to the rotation of the photosensitive drum for transferring the toner image onto copy paper;

a charger disposed between the developer and the transfer for charging the photosensitive drum at a specified level to assure a smooth transfer of the toner image from the photosensitive drum to the copy paper, the charger including a casing formed with a guide portion for guiding the copy paper to the transfer;

the casing being made of a plurality of separatable members including an intermediate vertical reinforced member defining a first chamber and a second chamber, the first chamber having an opening facing the photosensitive drum.

2. An image forming apparatus as defined in claim 1 wherein a charging wire is provided in the first chamber in a lengthwise direction of the casing, and the intermediate vertical reinforcing member has a guide opening extending in parallel with the charging wire:

the image forming apparatus further comprising:

cleaning member movable in the guide opening formed in the intermediate vertical reinforcing member, the cleaning member being adapted for cleaning the charging wire.

3. An image forming apparatus as defined in claim 2 wherein the second chamber has an outflow opening:

the image forming apparatus further comprising:

an enclosure member provided on an underside of the developer to define an ozone removal space, the ozone removal space communicating with the first and second chambers through the guide opening and the outflow opening.

4. An image forming apparatus comprising:

a photosensitive drum rotatable in a specified direction on which an electrostatic latent image is formed;

a developer disposed near the photosensitive drum for developing the electrostatic latent image into a toner image;

a transfer disposed on a downstream of the developer with respect to the rotation of the photosensitive drum for transferring the toner image onto copy paper;

a charger disposed between the developer and the transfer for charging the photosensitive drum at a specified level to assure a smooth transfer of the toner image from the photosensitive drum to the copy paper, the charger including a casing formed with a guide portion for guiding the copy paper to the transfer;

a support frame for supporting the photosensitive drum, the developer, and the charger in the form of a single unit, the support frame being withdrawable from a main body of the image forming apparatus;

the support frame including:

a front support wall having holding means for holding a front portion of the charger; and a rear support wall having an engagement hole and a guide hole at specified portions thereof;

the charger including:

a rear portion having an engagement projection engageable with the engagement hole and a slide member slidable in the guide hole;

whereby the charger is mounted on the support frame by inserting the slide member in the guide hole, moving the charger further rearward while the slide member is being supported at the guide hole until the engagement projection engages with the engagement hole, and rendering the front portion of the charger held by the holding means.

* * * * *